US007169718B1

(12) United States Patent
Rexroad

(10) Patent No.: US 7,169,718 B1
(45) Date of Patent: Jan. 30, 2007

(54) SHRINK-NET AND SYSTEM

(76) Inventor: John Rexroad, 12 Jackson Rd., Killingworth, CT (US) 06419

( * ) Notice: Subject to any disclaimer, the term of this patent is extended or adjusted under 35 U.S.C. 154(b) by 0 days.

(21) Appl. No.: 09/193,989

(22) Filed: Nov. 18, 1998

(51) Int. Cl.
*D03D 9/00* (2006.01)
*D04H 1/00* (2006.01)
*B32B 5/12* (2006.01)
*A47C 7/02* (2006.01)

(52) U.S. Cl. ..... 442/1; 442/2; 428/105; 428/119; 297/452.59; 297/452.63

(58) Field of Classification Search ..... 428/105, 428/119; 442/2, 1; 297/452.59, 452.63
See application file for complete search history.

(56) References Cited

U.S. PATENT DOCUMENTS 5,582,266 A * 12/1996 Rexroad et al. ..... 182/138
5,673,769 A * 10/1997 Rexroad et al. ..... 182/138
5,848,665 A * 12/1998 Rexroad et al. ..... 182/138
6,076,448 A * 6/2000 Rexroad ..... 87/12

* cited by examiner

*Primary Examiner*—Terrel Morris
*Assistant Examiner*—Lynda Salvatore
(74) *Attorney, Agent, or Firm*—Venable, Campillo, Logan & Meaney, P.C.

(57) ABSTRACT

The invention resides in a system and method of tensioning a net comprising a frame having at least two opposing frame members and a net extending therebetween. The net is made from material of cords of a water soluble yarn capable of high shrinkage rates when wetted with water and dried. A tensioning device may be provided along one of said frame sides for causing tensioning of localized regions in said mesh after said mesh is wetted with water. The invention further resides in a method of tensioning a net to a frame having at least two opposing frame members and the net extending therebetween such that by sizing the net larger than said frame and mounting the net onto the frame such that the border is located outside of the frame and wetting the net and allowing it to dry, the net shrinks around the frame taking up play otherwise existing prior to the wetting step.

12 Claims, 9 Drawing Sheets

SHRINK-NET AND SYSTEM

BACKGROUND OF THE INVENTION

Field of the Invention

The present invention relates to an improvement in a netting system, and relates more particularly, to improvements in mesh netting whereby the mesh is capable of being made taut around a frame through the intermediary of a shrinkable net fiber which has a reduced length when wetted and then dried.

It is often desirable to maintain a net mesh in a taut condition while it is held in place on a structure. Typically, for example, in the case of a barrier net used for holding people from going over a ledge, it is desirable to maintain the person with out him or her leaning over a ledge. In prior art nets, play in the net would undesirably allow this to happen due to the net being allowed to stretch outwardly. Additionally, in the amusement field, it is common to use a mesh with wide gap openings for climbing. Often however, the nets used in this manner also have play in both the vertical and horizontal directions making them less stable and hence less desirable to be used for children.

Accordingly, it is an object of the invention to provide an improved shrinking net whereby the net can be assembled onto a frame and the mesh thereafter shrunk in size to allow for tensioning of the mesh relative to the frame without having to allow for longer lengths of rope which otherwise would be needed for assembly purposes.

It is a further object of the invention to provide a device of the aforementioned type wherein a mesh can be quickly and easily retensioned after use.

It is still a further object of the invention to provide a net which can be interlocked at node points or at other locking points by causing portions of the rope cord to bind on itself and/or be connected to other rope components.

SUMMARY OF THE INVENTION

The invention resides in a method and apparatus for tensioning a net which is made taut by wetting the net material such that the material shrinks when wetted and dried. More specifically, the invention resides in a net system comprising a frame having at least two opposing frame members and a net extending therebetween. The net is made from a material of cords of a water soluble yarn capable of high shrinkage rates when wetted with water and dried. A means may be provided along one of the frame sides for causing tensioning of localized regions in the net.

The invention further resides in a method of tensioning a net to a frame by providing the net with a border, providing the net from a material of cords of a water soluble yarn capable of high shrinkage rates when wetted with water and dried, sizing the net to be larger than the frame, mounting the net onto the frame such that the border is located outside of the frame, and wetting the net and allowing it to dry such that the net shrinks around the frame taking up play otherwise existing prior to the wetting step.

DETAILED DESCRIPTION OF THE PREFERRED EMBODIMENTS

Figure 1:
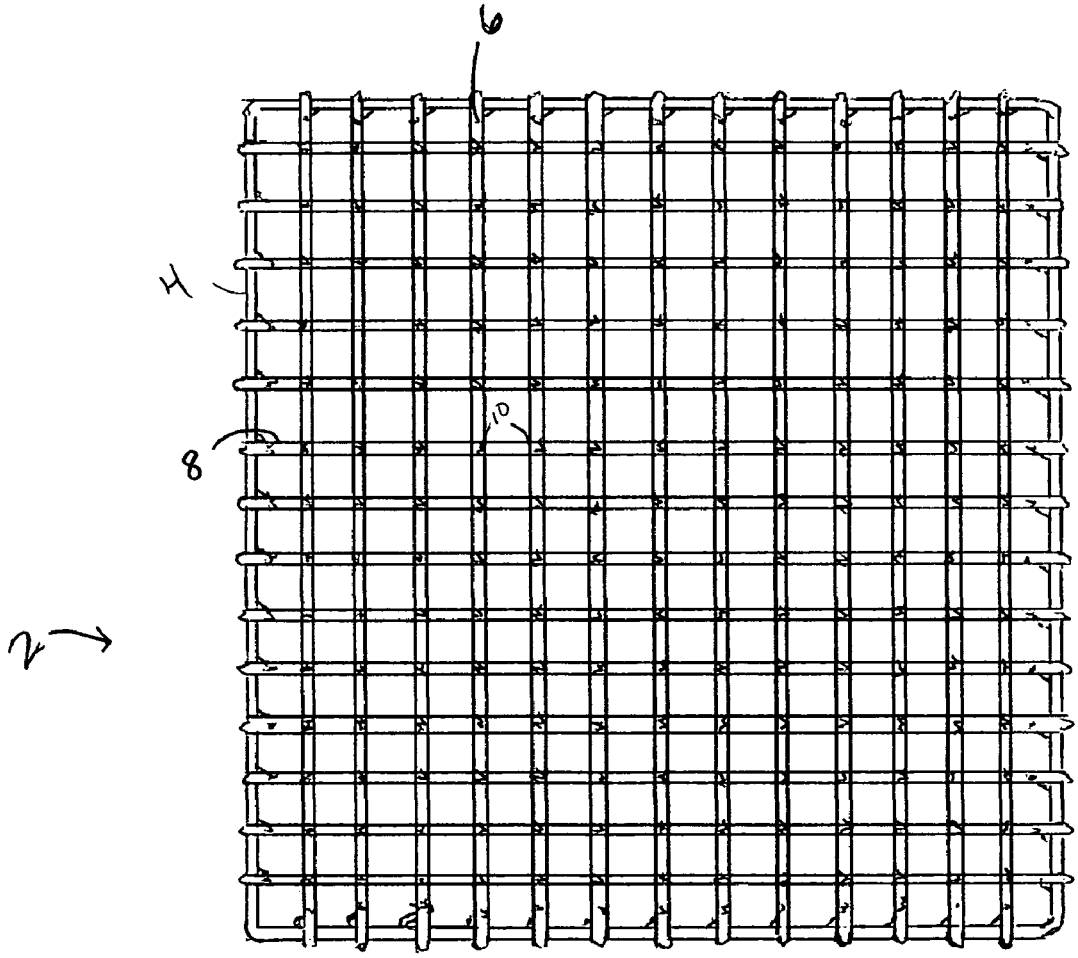
FIG. 1 is a plan view of a net embodying the invention.

FIG. 1 is a plan view of net 2, consisting of an outer border 4 and tucked construction, however, cross-lock construction is also possible, and a material in addition to that disclosed in this invention can also be used, such as a core in a web rope, or a blend rope. The net 2 further is comprised of vertically extending weft members 6, 6 and horizontally extending warp members 8, 8 which intersect together with one another at intersections or nodes 10, 10. The weft 6 and warp 8 members are made in whole or in part from a shrinkable material which will be discussed in greater detail later with respect to TABLES A and B below.

Figure 2:
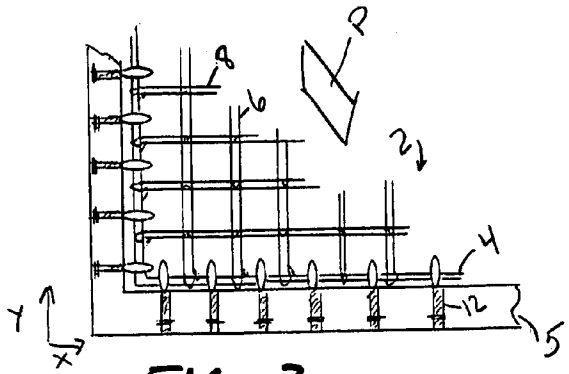
FIG. 2 illustrates a net attached to a frame structure by means of eye bolts.

Referring now to FIG. 2, it should be seen that the net 2 is attached to a rigid frame 5 through the intermediary of a plurality of eyebolts 12, 12 which are threadedly connected within corresponding openings formed in and around the perimeter of the frame 5. The eyelet part of the eyebolts receive the border member 4 so as to pull the net 2 in both the X and Y coordinate directions and maintain the net 2 coextensively with the plane P.

Figure 3:
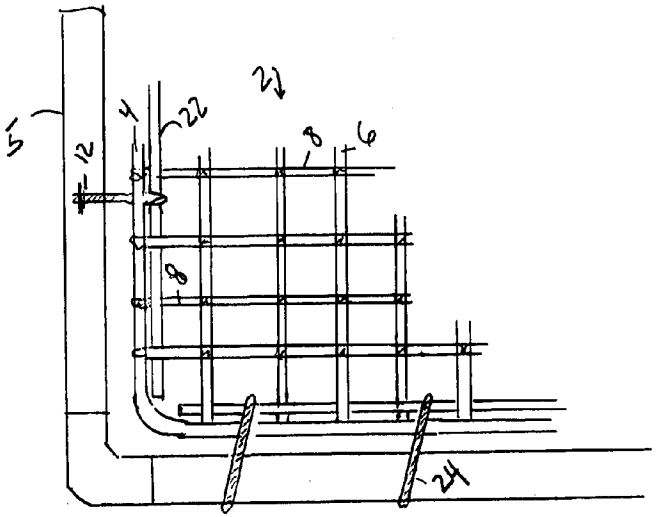
FIG. 3 illustrates a tensioning rod woven in the mesh at the outer border.

As seen in FIG. 3, in lieu of using eyebolts 12, 12 exclusively around the perimeter of the frame 5, the number of eyebolts 12, 12 can be reduced by using a tensioning bar 22 provided along opposed side lengths of the border member 4. In the case of the vertical sides of the border 4, the tensioning bar 22 is threaded between the warp members 8, 8 and in the case of the horizontal sides of the border 4, the tensioning bar is threaded between the weft members 6, 6. The use of the tensioning bars 22, 22 allows for less securement points to be used between the frame and the net because the bars provide a longer contact surface against which the border 4 acts, as opposed to the single point contact which exists with the direct eyebolt connection of FIG. 2. In addition, it should be seen that only one of the two opposing sides requires securement through eyebolt connection, thereby allowing the other opposite side to be secured via, for example a lashing connection 24 as shown along the bottom side of the net in FIG. 3.

Figure 4A:
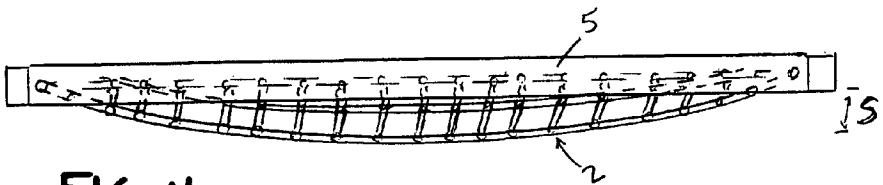
FIG. 4*a* illustrates the net installed in a frame prior to shrinkage.
Figure 4B:
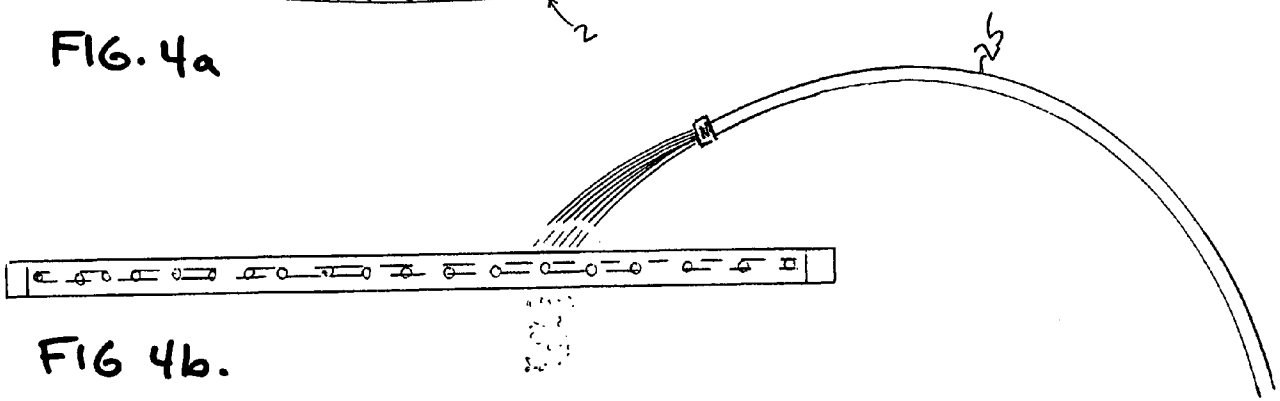
FIG. 4*b* illustrates the net after tensioning by applying water.

Referring now to FIGS. 4*a* and 4*b*, it should be seen that the net 2 of the present invention is made from a material which comprises at least portions of the weft and warp members 6 and 8 and is capable of shrinking in size once wetted. This material is better referred to as water soluble shrinkable yarns which react to wetting by reduction in length, up to the point where strain is imposed on the yarns by, for example, an outside force, such as produced by reacting against a rigid frame.

The tables A and B below set forth the specific characteristics of the yarns which can comprise in whole or in part, the construction of the weft warp and border members. The yarns are sold by Kuraray Co. LTD. under the tradename, Kuralon Type-T rope, through Kawashima Trading Co. Ltd., 1-6-28, Kyutaro-Machi, Chuo-ku, Osaka Japan.

TABLE A

1. Properties of Water Soluble Kuralon Perlohke Yarn
In addition to the soluble property in hot water, water soluble Kuralon perlohke yarn has the characteristic of remarkable high shrinkage force in water.
1. Characteristics of water soluble Kuralon perlohke yearn.
(1) High shrinkage ratio in wet state.
40% at free tension
(2) High shrinkage force in wet state.
In case of 10's, the shrinkage force is about 30 gr. When the both ends of yarn are fixed.
(3) High elongation at break.
(4) At wet state it shows elasticity like rubber.
(5) Abrasion resistance at wet state is a little inferior to that of normal Kuralon perlohke yearn.
(6) Tensile strength is about half of normal Kuralon perlohke yarn.
(7) It dissolves in water at more than 80° C.
8) Standard Properties of Kuralon Yarn.

| Description | 2005P20/1T | 2005P10/1T |
|---|---|---|
| Yarn Count | ECC 20'S | ECC 10'S |
| Dry | | |
| Tensile Strength Kg | 0.60 | 1.70 |
| Tenacity g/dr. | 2.20 | 3.01 |
| Elongation % | 15.0 | 17.0 |
| Wet | | |
| Tensile Strength Kg | 0.25 | 0.49 |
| Tenacity g/dr. | 0.92 | 0.87 |
| Elongation % | 102 | 108 |

In addition to the specific characteristics above in Table A, below listed in TABLE B, are further characteristics illustrative of the yarn material used by the present invention.

TABLE B

KURALON (PVA) HIGH SHRINKAGE CORD

This yarn exhibits the unique behavior of fast shrinkage combined with a high shrinkage force when it becomes wet.
1) Initial. Reactive Properties
(a) Fast shrinkage:
The time required to reach 30% shrinkage is about 7 seconds in water at 20 Deg. C. and about 4 seconds in water at 30 Deg. C.
(b) High shrinkage:
The shrinkage ratio is about 75% in water at 20 Deg. C. and about 78% in water at 30 Deg. C.

TABLE B-continued

KURALON (PVA) HIGH SHRINKAGE CORD (c) High shrinkage force:
After absorbing water, a high shrinkage force is readily apparent. The shrinkage force is about 170 gram (0.1 gram/danier) in water at 30 Deg. C. after 10 seconds.
2) Long Term Properties
(a) High strength after shrinkage:
Strength is about 1 gram per denier after yarn is soaked for 16 hours.
(b) Elasticity can be maintained for a long time.
3) Standard Properties

| | |
|---|---|
| Denier | 1786 |
| Unit Length (meter/gram) | 5.0 |
| Moisture Content (%) | 9.2 |
| Strength (Kg) | 3.88 |
| Tenacity (gram/dr) | 2.17 |
| Elongation at Break (%) | 26.0 |

Figure 5:
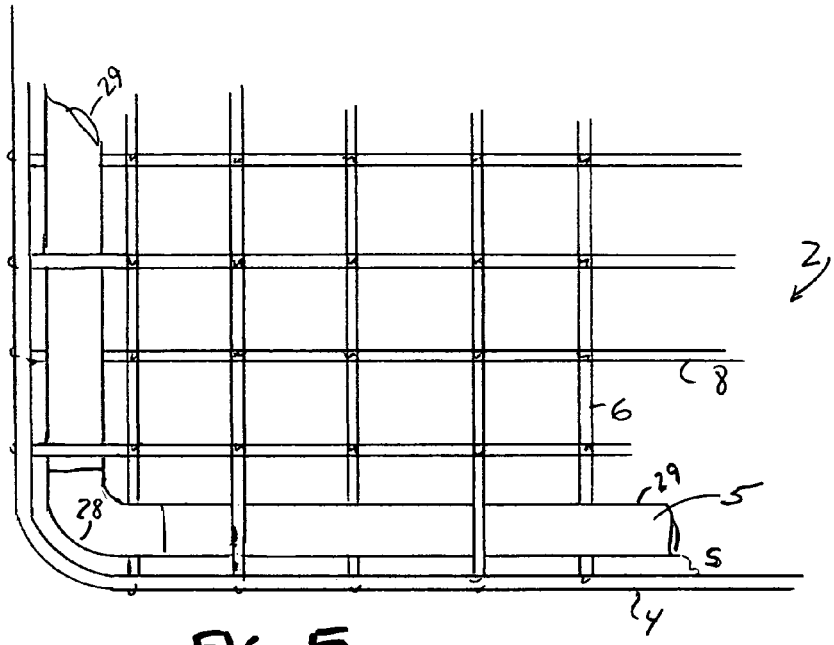
FIG. 5 illustrates installing the net with the frame woven in the mesh, the frame could be pipe or other material.

As seen in FIGS. 4*a* and 4*b*, the net 2 is mounted onto a frame 5, such that a slack S exists between it and the frame 5. Thereafter water is applied through a hose 25 or the like and the net is caused to shrink to the point where it lies generally coextensively within the plane P. As seen in FIG. 5, one advantage of using a net which is capable of reducing its size is that the frame 5 can be assembled about the net taking advantage of the slack which can be provided for allowing the frame to be assembled. That is, the frame 5 conventionally will have an elbow 28 which connects with side members 29, 29. Usually there will need to be some play allowed for in the net in order to allow the members 29, 29 to be telescopically fitted within the elbow, or vice versa. This play or slack S is thus taken up by the subsequent shrinking step as discussed previously with respect to FIGS. 4*a* and 4*b*. That is, if the net was manufactured to size, this frame would not be able to be assembled as the tubing would not be able to pull apart to allow the elbows or other fittings to telescope on the tubing/pipe.

Figure 6:
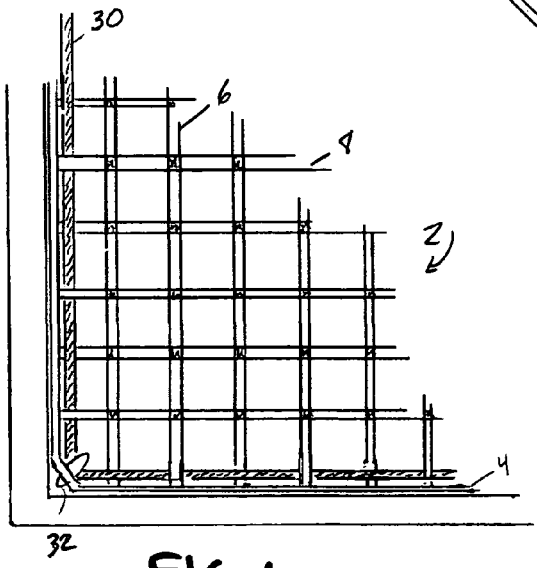
FIG. 6 illustrates the net installed in the frame or structure with cable or rope.
Figure 7:
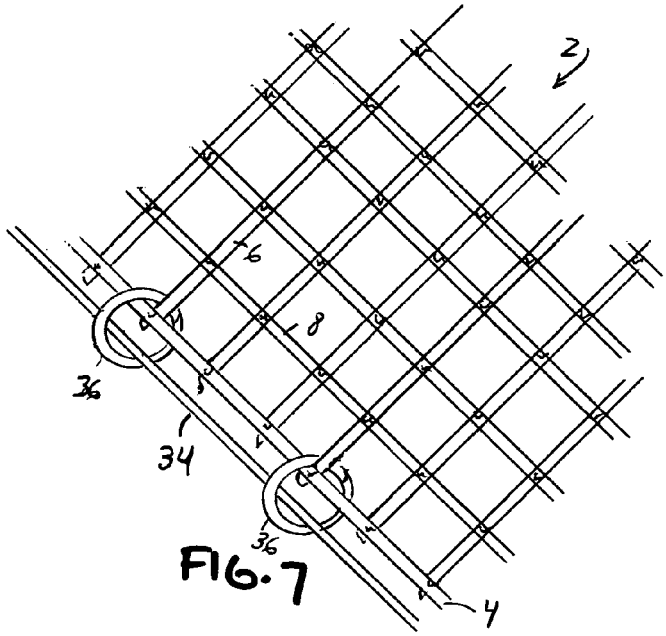
FIG. 7 illustrates the net being installed to a cable using rings placed along the net border.

In FIG. 6, a locating cable 30 is used in lieu of either the several eyebolts of FIG. 2 or the rods 22 of FIG. 3. In this embodiment, the cable or rope is threaded through the weft and warp members immediately adjacent the border member 4. At the corners of the frame is disposed a single eyebolt 32 which is connected to the frame at a forty-five degree angle. As seen in FIG. 7, in lieu of a frame, the net 2 may be connected to a tensioned cable 34 through the intermediary of rings 36 which connect around the border 4 and the cable 34. It is noted that tensioning of the net members can be accomplished at any time once the net is mounted to the frame, including during the wetting and drying out periods.

Figure 8:
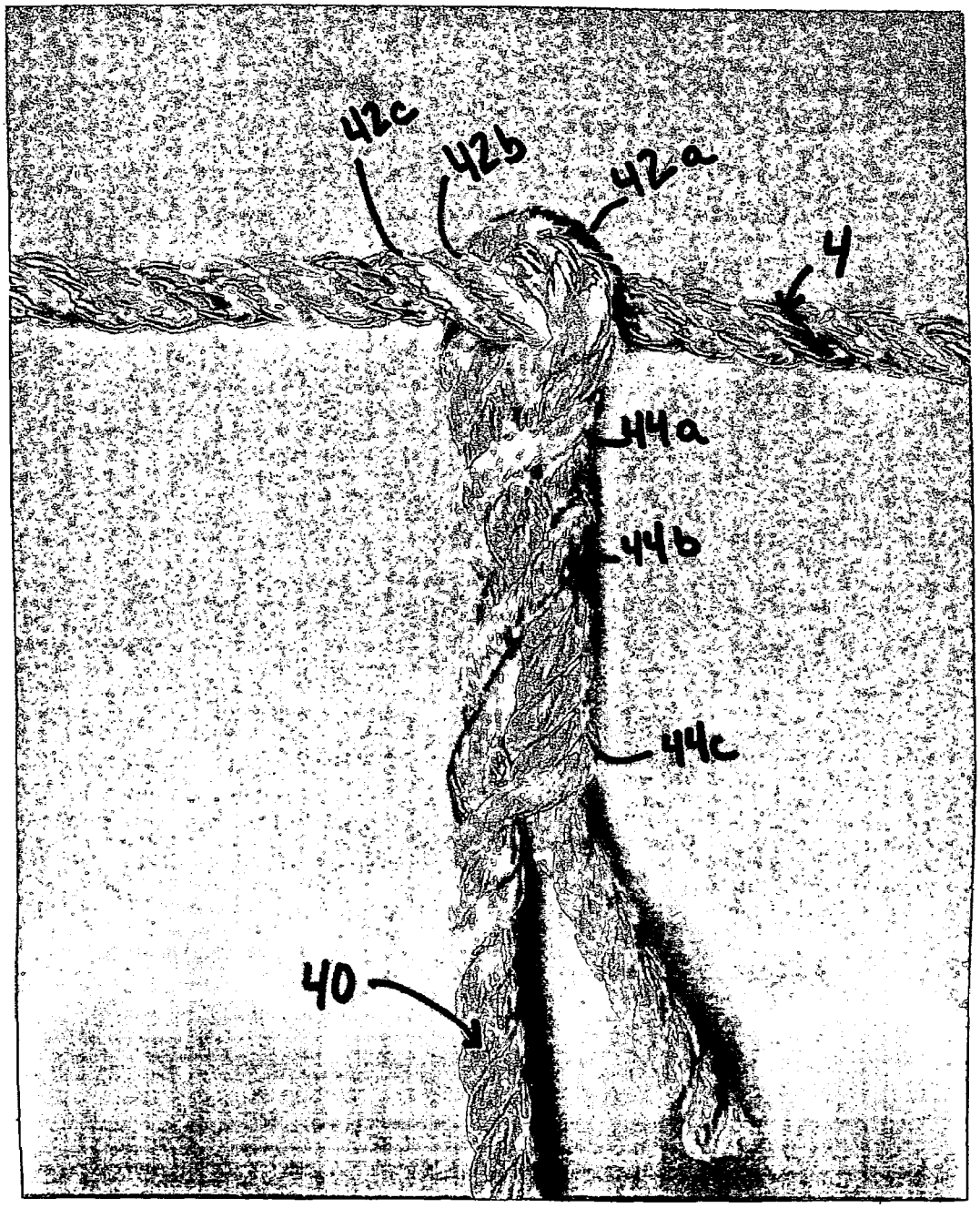
FIG. 8 illustrates a splice to a border with twisted rope.

Referring now to FIG. 8, it should be seen that the device shown in this embodiment covers a splice between a border and a twisted rope. Here, the border illustrated as 4 connects to a member 40, which for discussion purposes, can take the form of either a weft or warp member 6 or 8. As seen in FIG. 8, the member 40 is passed through one strand 42*a* of the border 4 separating the remaining members 42*b* and 42*c* in the border 4 and then is tucked under two or more strands 44*a*, 44*b* and 44*c* of itself. When wetted and allowed to dry in the manner discussed above and set forth in detail in Tables A and B, the passing through of the rope end back on itself prior to wetting causes a highly effective lock to be created.

Figure 9A:
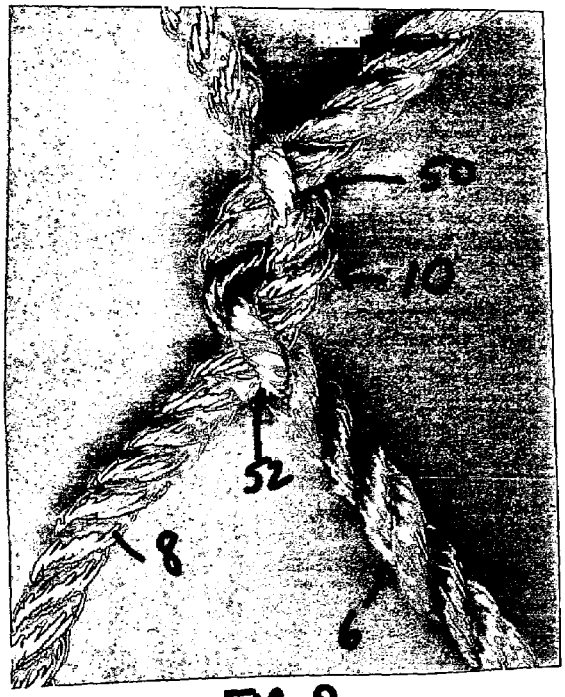
FIG. 9*a* illustrates an intersection of the net.
Figure 9B:
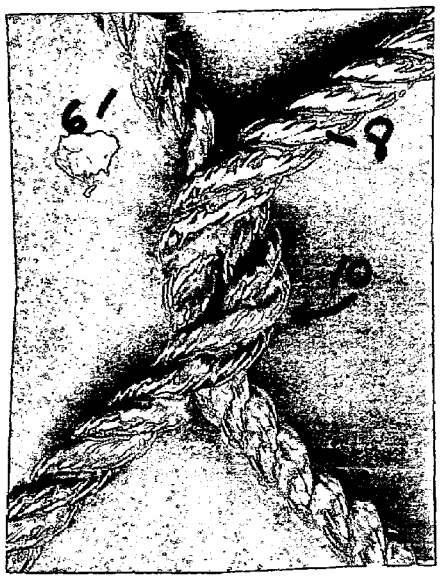
FIG. 9*b* illustrates the same as FIG. 9*a* but from the other side.

Referring now to FIGS. 9*a* and 9*b*, a structure of anode 10 is shown. The node 10 in FIG. 9*a* sows the intersection of weft and warp members 6 and 8. Here weft member 6 passes through warp member 8 at point 50 while warp member 8 passes through weft member 6 at point 52. When wetted and allowed to dry in the manner discussed above and set forth in detail in Tables A and B, the cross passing through of weft and warp members 6 and 8 prior to wetting causes a highly effective lock to be created.

Figure 10A:
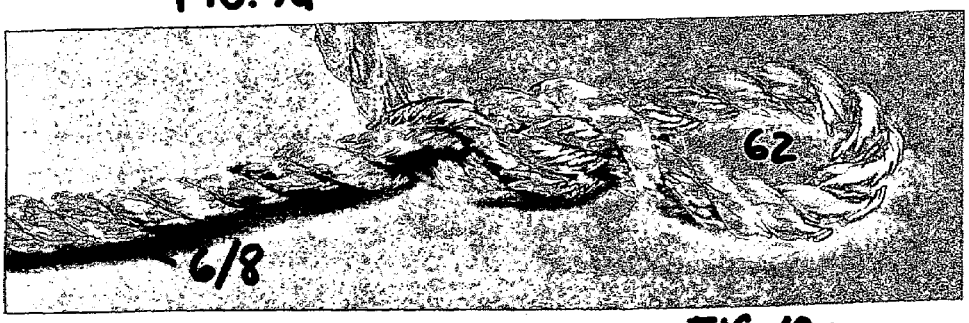
FIG. 10*a* illustrates a border rope looped and tucked back in itself.
Figure 10B:
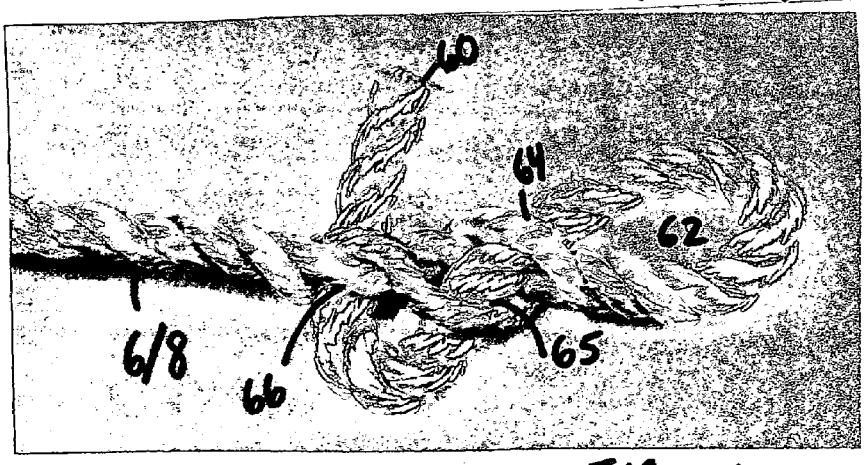
FIG. 10*b* illustrates the rope of FIG. 10*a* except open for further clarity.

The end structure shown in FIGS. 10*a* and 10*b* illustrates end of one of the warp or weft members which is capable of being connected through a retaining rod 22 such as shown in FIG. 3 or, alternatively, piercing through a border member as disclosed above with respect to FIG. 8. However, in this embodiment, it should be seen that the end 60 of the member 6/8 pierces back on itself through one cord of the rope at 64 and 65 after forming a loop 62 and then again pierces back on itself in an opposite 180° direction at point 66. By way of reference, such a double back type connected is disclosed in commonly owned U.S. Pat. No. 5,622,094 entitled "Hollow Braid Net and Method of Making" issued on Apr. 22, 1997 filed in the name of John Rexroad and filed on Mar. 30, 995 as application Ser. No. 08/414,185, and which application being commonly owned with the Applicant of the present invention and is hereby incorporated reference. When wetted and allowed to dry in the manner discussed above and set forth in detail in Tables A and B, the formation of end 60 of the member 6/8 piercing back on itself through one cord of the rope at 64 and 65 after forming a loop 62 and then again pierces back on itself in an opposite 180° direction at point 6 prior to wetting causes a lock to be created in a highly effective manner.

Figure 11:
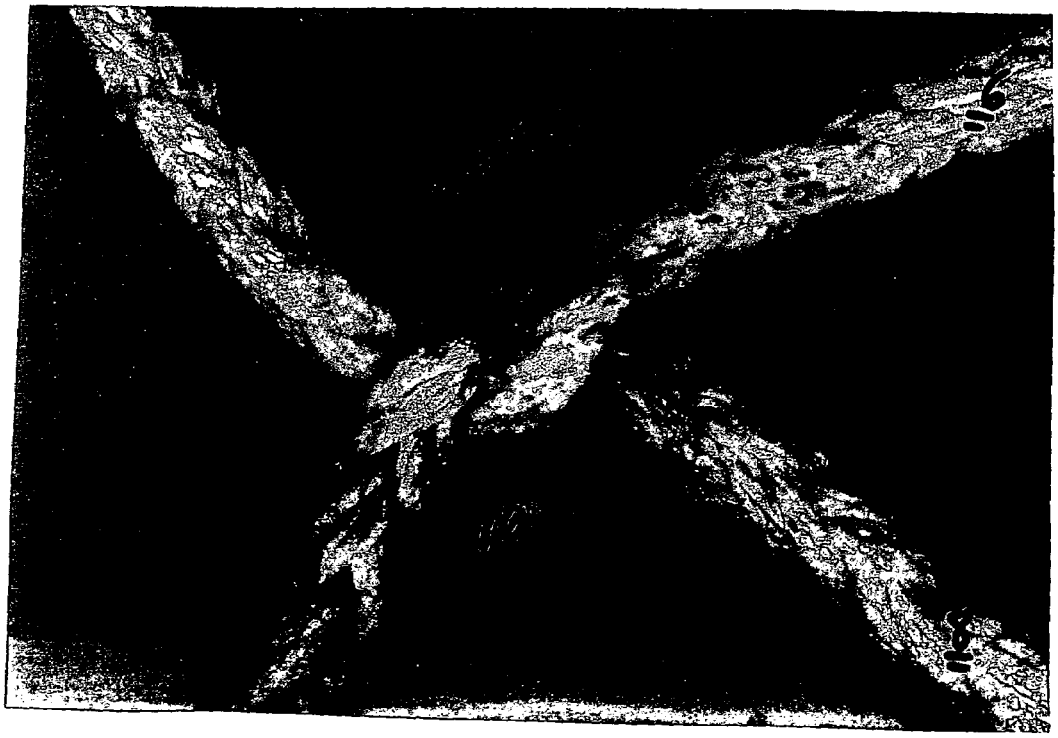
FIG. 11 illustrates an intersection of the mesh with a braided rope.

Referring now to FIG. 11, it should be seen that the connection shown in FIG. 11 is the same as shown in FIGS. 9*a* and 9*b*, except that the material used as the weft and warp members 6 ad 8 is that of a braided rope rather than a twisted one. Notwithstanding, intersection 10 is caused by the weft member 6 passing through the warp member 8 and then the warp member 8 passing through the weft member 6. It should be further understood that the braided rope illustrated by the members 6 and 8 can be made completely of the shrinkable cord material of Tables A and B above or can be braided with strands thereof which allows the member to have a soft touch such as when formed as a composite with a microfilament material. When wetted and allowed to dry in the manner discussed above and set forth in detail in Tables A and B, the formation of intersection 10, prior to wetting, is caused by the weft member 6 passing through the warp member 8 and then the warp member 8 passing through the weft member 6. In this embodiment, the passed through weft and warp members 6 and 8 create a highly effective lock.

Figure 12:
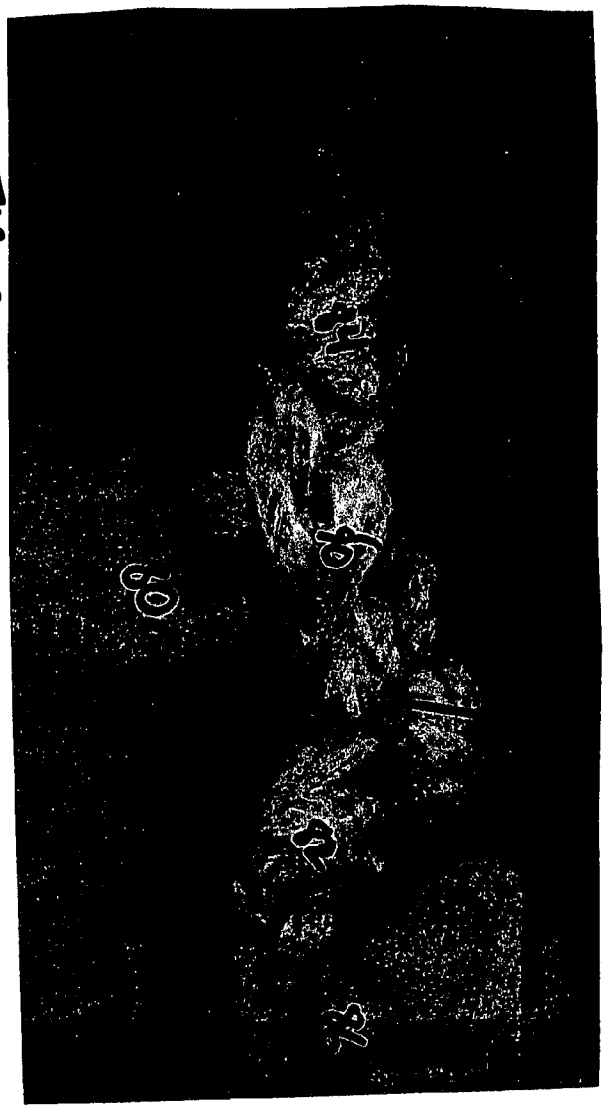
FIG. 12 illustrates an end to end splice of a braided rope.

Referring now to FIG. 12, it should be seen that a splice 80 of a braided rope is shown. This splice 80 is made between two end to end pieces whose distal ends are shown at 82 and 84. Braided rope illustrated as 86 is passed through braided rope illustrated as 88 at point 90 and braided rope 88 passes through braided rope 86 at point 92. Thereafter, distal end 82 is turned 90° and passes through the side of braided rope 86 while distal end 84 of braided rope 86 is turned 90° and passes through the side of braided rope 88. When wetted and allowed to dry in the manner discussed above and set forth in detail in Tables A and B, the passed through rope portions of the rope members create a highly effective lock.

Figure 13:
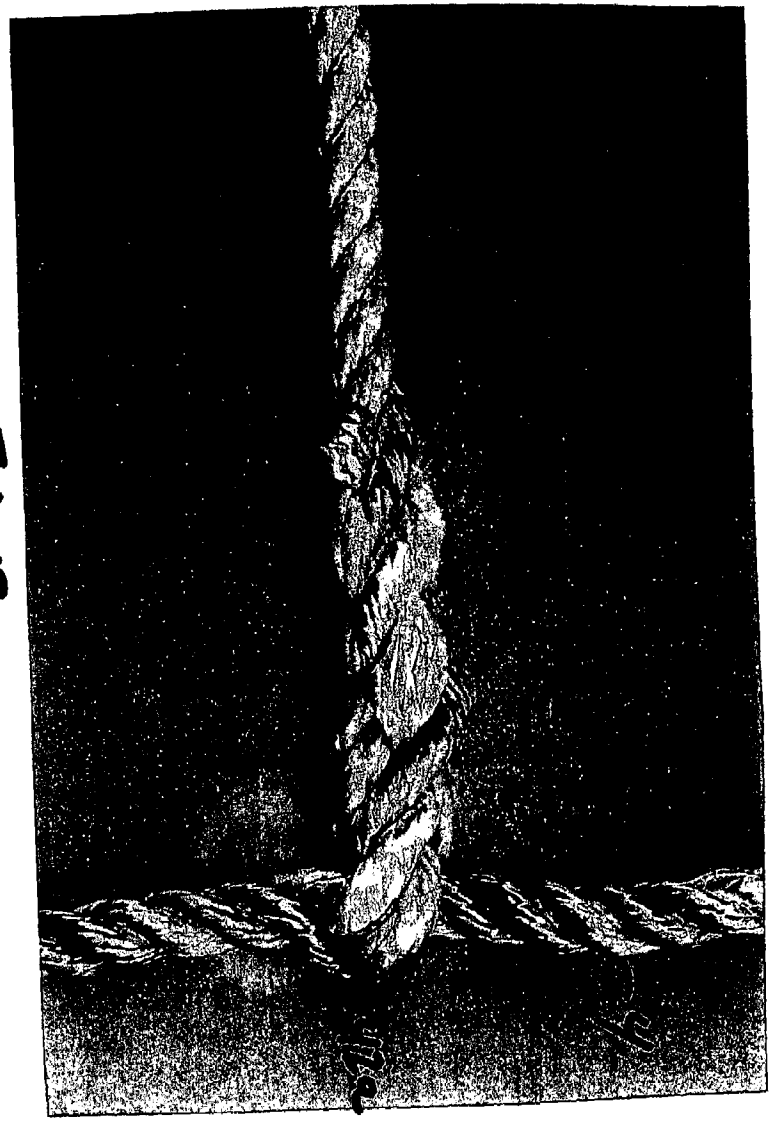
FIG. 13 illustrates an intersection of the mesh to the border.

Referring now to FIG. 13, it is seen that the structure shown in FIG. 13 is the same as that shown in FIG. 8, except that the ends of either the warp or weft members as represented by numeral 40 are separated and then passed back in an over and under fashion into the double back portion of the rope member. When wetted and allowed to dry in the manner discussed above and set forth in detail in Tables A and B, the passing back over and under cords of the doubled back portion of the rope member effects a highly effective lock.

Figure 14:
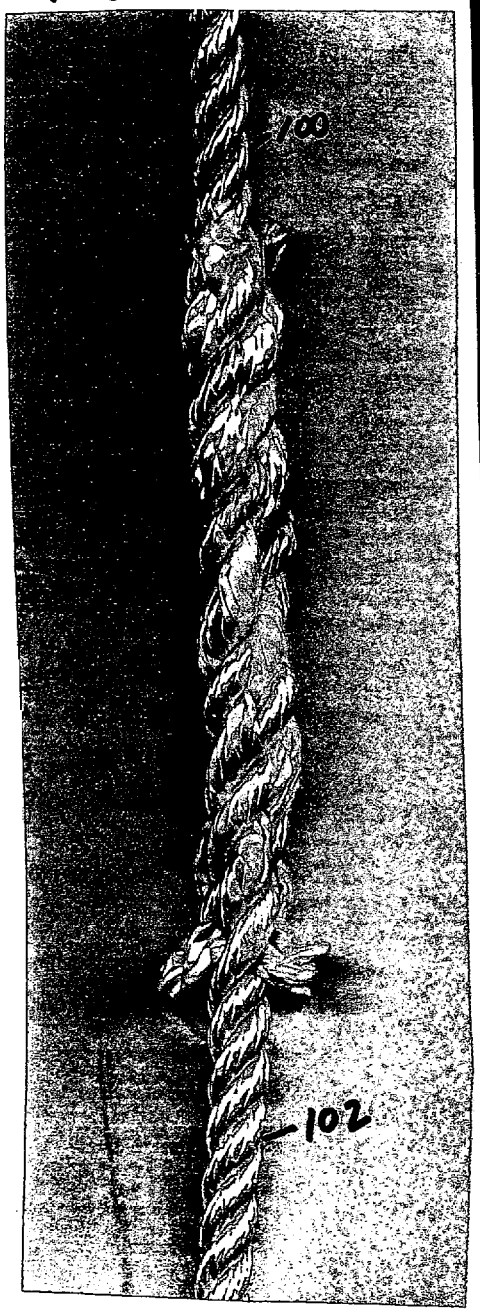
FIG. 14 illustrates an end to end splice of a twisted rope.

Referring now to FIG. 14, an end to end splice of braided rope 100 and 102 is shown. Here rope member 102 is passed between one cord member of rope 104 and rope 104 is passed under one cord member of rope 102 and the process is repeated linearly one or more times with both ends until no ends of the cord members are left dangling. When wetted and allowed to dry in the manner discussed above and set forth in detail in Tables A and B, the passing through of one rope member through the cord portion of the other rope member and vice versa effects a highly effective lock of the members.

Figure 15:
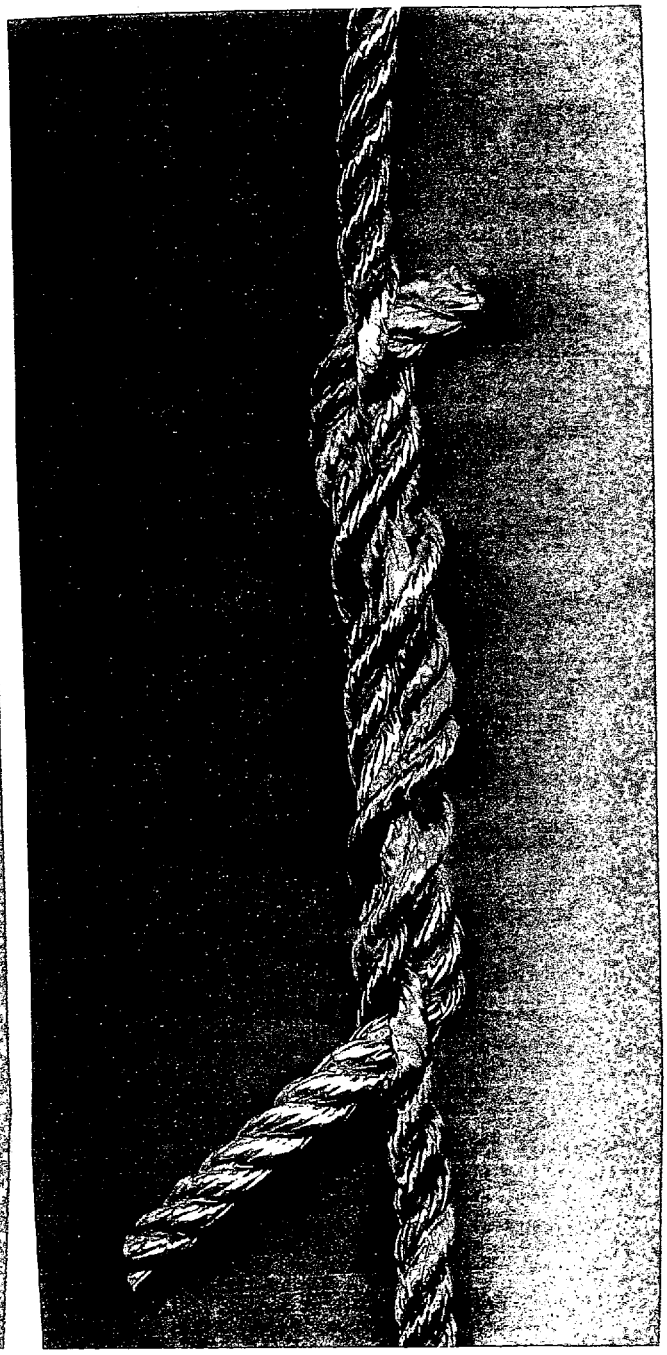
FIG. 15 illustrates another end to end splice of a twisted rope.

As illustrated in FIG. 15, the splice between the twisted rope members 102 and 104 is accomplished by opening the ends of each of the members 102 and 104 and linearly splicing each end in an over-under fashion in the opposing rope. When wetted and allowed to dry in the manner discussed above and set forth in detail in Tables A and B, the splicing of each end of one rope member through that of the other and vice versa effects a highly effective lock of the members.

Figure 16:
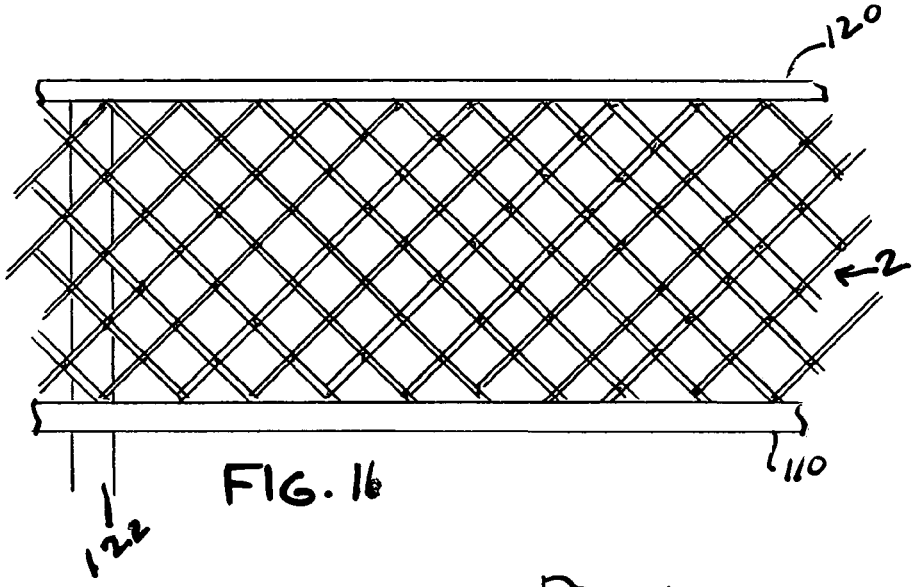
FIG. 16 illustrates the material installed as a barrier, such as a fence.

As illustrated in FIG. 16, the mesh 2 may be installed in a barrier, such as a fence, and is disposed between two horizontally spaced support rails 110 and 120 which, as typical, are secured by post(s) 122 to a support. The rails 120 and 110 may connect to the mesh 2 in the manner such as discussed previously with respect to FIGS. 1–7.

Figure 17:
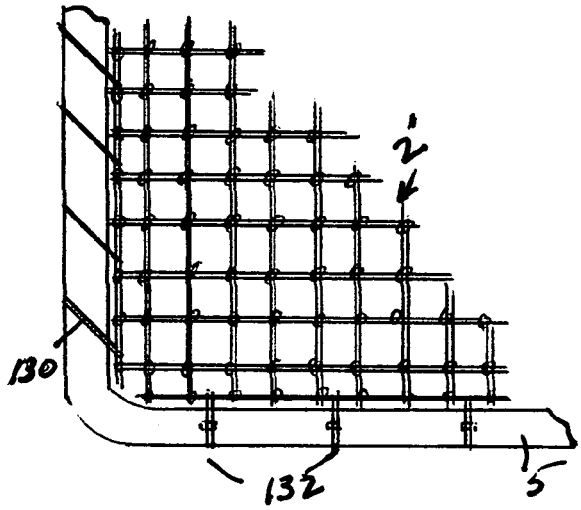
FIG. 17 illustrates the material installed as a barrier, such as in a ball pit or children play unit.

As illustrated in FIG. 17, the mesh 2' is of a smaller gauge than the net 2 disclosed in FIGS. 4 and 5, but nevertheless is comprised in whole or in part of the water soluble yarns disclosed above in tables A and B. The mesh 2' preferably is of the construction disclosed in copending U.S. patent application Ser. No. 09/012,427 filed on Jan. 22, 1998 in the name of John Rexroad and entitled "Method of Using Barrier Material and System" which application being commonly signed with the present invention and being hereby incorporated by reference. The mesh 2' is installed as a barrier such as in a ball pit where children play or other children's play unit. The left side of the L-shaped frame 5 of FIG. 17 shows a lashed in place connection 130 while the bottom run of the L-shaped frame includes plastic tie wrap connections 132. The mesh is a knotted mesh shown in a square orientation but could also be in a diamond orientation.

Figure 18:
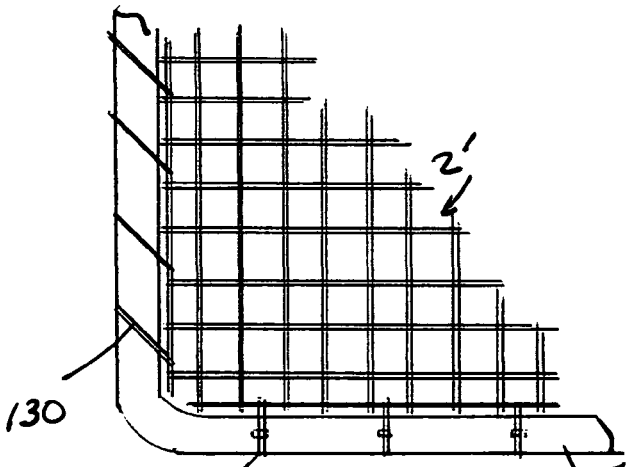
FIG. 18 illustrates the material installed as shown in FIG. 16 except the material is rachel, knottless (knitted).

FIG. 18 is an illustration similar to that shown in FIG. 16 except that the material is a rachel knottless knitted mesh.

By the foregoing, an improved shrink net system and article has been described by way of the preferred embodiment. However, numerous modifications and substitutions may be had without departing from the spirit of the invention. Accordingly, the invention has been described by way of illustration rather than limitation.

What is claimed is:

1. A net system comprising a frame having at least two opposing frame members and a net extending there between;

said net being made from a material of cords of a water soluble yarn that exhibits high shrinkage rates when wetted with water and dried, such that said yarn reduces in length up to a point where strain is imposed on said yarn by said frame; and means provided along one of said frame sides for causing tensioning of localized regions in said net.

2. A system as defined in claim 1 wherein said net is comprised of weft members and perpendicularly extending warp members connected to a border member which intersect together with one another at intersections or nodes, and wherein one of said border, weft and warp members is made in whole or in part from a shrinkable material when wetted and dried.

3. A system as defined in claim 1 wherein said tensioning means includes a connecting rod extending along one of said frame members and threaded between the border of the weft and warp members.

4. A system as defined in claim 2 wherein said frame includes a plurality of adjustment bolts which receive a border member of said net.

5. A system as defined in claim 2 further characterized in that the net is installed on a frame prior to shrinkage.

6. A system as defined in claim 2 wherein a locating cable is provided and is threaded through the weft and warp members immediately adjacent to the border member and at the corners of the frame is disposed a single eyebolt which is threaded to the frame at a forty-five degree angle.

7. A system as defined in claim 2 wherein said net includes a splice between said border and a weft or warp member, said splice includes a twisted warp or weft member and a twisted cord border member which weft or warp member is passed through one strand of the border member separating the remaining members in the border member and then is tucked under two or more strands of itself and then wetted and allowed to dry.

8. A system as defined in claim 2 wherein said net includes a node at the intersection of weft and warp members wherein the weft member passes through the warp member and the warp member passes through the weft member and then is wetted and allowed to dry.

9. A system as defined in claim 2 wherein said warp of weft members have an eyelet formed by the end of the weft or warp member piercing back on itself through one cord of the weft or warp member after forming a loop and then again piercing back on itself in an opposite 180° direction and wetted and allowed to dry.

10. A system as defined in claim 2 wherein said net includes a splice of a braided rope made between two end to end pieces, wherein one rope is passed through the other rope and the other rope passes through the one rope and thereafter the distal end of the one rope is turned 90° and passes through the side of the other rope while distal end of the other rope is turned 90° and passes through the side of the one rope braided rope, the two ropes are locked together once wetted and dried.

11. A system as defined in claim 2 wherein said net includes the warp or weft members each having a loop at one end thereof created by separating the end cords thereof and then passed back through the separated cords back in an over and under fashion into the double back portion of the rope member and locking the doubled back portion by wetting and then drying.

12. A system as defined in claim 2 wherein said net includes an end to end splice of braided rope wherein one rope member is passed between one cord member of the other rope and the other rope is passed under one cord member of the one rope and the process is repeated linearly one or more items with both ends until no ends of the cord members are left dangling, the passing of rope members is locked by wetting and then drying of the one and the other rope members.

* * * * *